United States Patent [19]

Landry

[11] Patent Number: 4,967,853

[45] Date of Patent: Nov. 6, 1990

[54] WIRELINE RETRIEVABLE GAUGE SYSTEM

[76] Inventor: Ronald J. Landry, Rte. 3, Box 237, Lafayette, La. 70506

[21] Appl. No.: 373,949

[22] Filed: Jun. 29, 1989

[51] Int. Cl.[5] ..... E21B 47/06

[52] U.S. Cl. ..... 175/50; 166/113; 166/242

[58] Field of Search ..... 175/50, 40, 308, 309, 175/320; 166/250, 381, 385, 113, 117, 162, 242, 243, 236

[56] References Cited

U.S. PATENT DOCUMENTS

| | | | |
|---|---|---|---|
| 4,711,123 | 12/1987 | Christensen | 166/113 |
| 4,735,264 | 4/1988 | Burris, II et al. | 166/242 |
| 4,817,710 | 4/1989 | Edwards et al. | 166/113 |

OTHER PUBLICATIONS

Otis Engineering Catalog, String Completions and Landing Nipples, pp. 5954, 5958, 5972 & 5973.

Pandex Corporation, Concentric Full Bore Gauge Carrier and Eccentric Gauge Carrier.

*Primary Examiner*—Ramon S. Britts

*Assistant Examiner*—Terry Lee Melius

*Attorney, Agent, or Firm*—Fleit, Jacobson, Cohn, Price, Holman & Stern

[57] ABSTRACT

A gauge carrier which is tubing conveyed with a wireline retrievable gauge system for more effectively evaluating reservoir potential and whether it is economically feasible to complete the well and place it into production. The gauge carrier and method of this invention provides effective solutions to problems which arise when endeavoring to measure and accurately record bottom hole pressure during temporary flow tests as well as on a permanent hookup on a well completion. The gauge carrier can be run on the tubing or drillstem above or below a packer as a part of a temporary or permanent completion and the gauge assembly can be retrieved by the use of a wireline after the well completion process has been completed. The gauge carrier provides a support structure for mechanical or electronic gauges utilizing components which are readily available or easily constructed to enable the measuring gauges to be retrieved, checked and easily run back into the gauge carrier if additional information is required at any time during flowing and/or shut-in conditions.

17 Claims, 5 Drawing Sheets

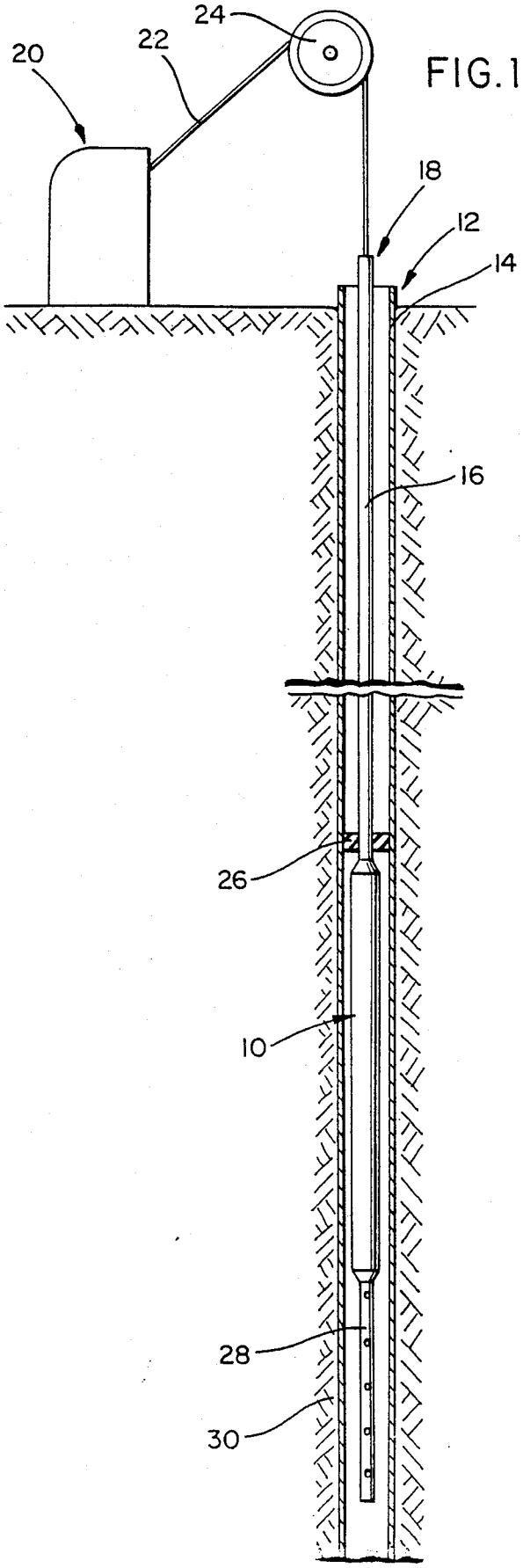
FIG. 1
FIG. 6
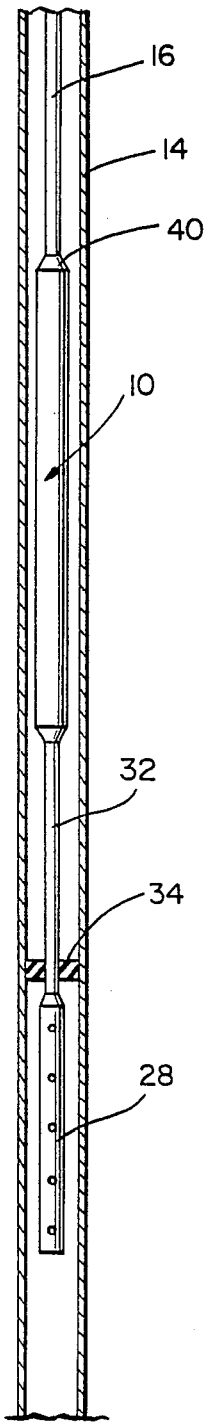
FIG. 7
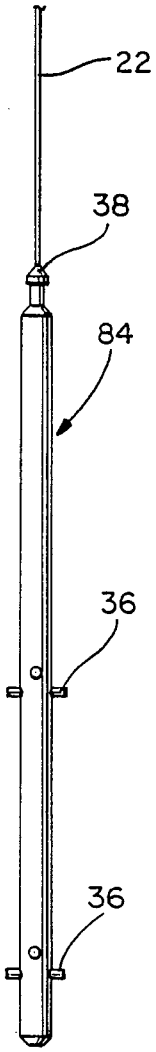

WIRELINE RETRIEVABLE GAUGE SYSTEM

BACKGROUND OF THE INVENTION

1. Field of the Invention

The present invention generally relates to equipment used in oil and gas wells after drilling is completed and more particularly to a gauge carrier which is tubing conveyed with wireline retrievable gauges or gauge assembly for more effectively evaluating reservoir potential and whether it is economically feasible to complete the well and place it into production. The gauge carrier of this invention provides effective solutions to problems which arise when endeavoring to measure and accurately record bottom hole pressure during temporary flow tests as well as on a permanent hookup on a well completion. The gauge carrier can be run on the tubing or drillstem above or below a packer as a part of a temporary or permanent completion and the gauge assembly can be retrieved by the use of a wireline after the well completion process has been completed. The gauge carrier provides a support structure for mechanical or electronic gauges utilizing components which are readily available or easily constructed to enable the measuring gauges to be retracted, checked and easily run back into the bore hole if additional information is required at any time during flowing and/or shut-in conditions.

2. Information Disclosure Statement

It is well-known practice for oil and gas well service companies to gauge well performance with the existing method or practice involving a cage that may be integral with the drill string being lowered into the well with the drill string with the cage carrying a plurality of units for measurement and recording of conditions at the bottom of the bore hole with this information then being used to determine whether the well is to be placed into production. This known technique, which is usually referred to as drillstem testing which basically involves the use of well-known downhole equipment which can be manipulated from the surface to accomplish basic functions by following certain procedural steps. The basic equipment used is a string of tubing o drill pipe which is also known as a test string which extends from the surface to a predetermined depth within the well casing thereby providing control of the underground environment with the casing containing the drilling mud that was used to drill the well and to control and contain any reservoir fluids encountered.

The lower end of the test string is provided with a packer which can be set against the wall of the casing and released as required to prevent reservoir fluids from entering the casing in order to keep the well under control after the reservoir has been perforated. In order to further perforate and evaluate the reservoir, a gauge carrier is usually affixed to the drill string beneath the packer with the gauge carrier having pressure recording gauges and the like affixed in recesses or receptacles machined into the exterior of a heavy wall pipe in order to prevent the gauges from contacting the wall of the casing which could result in damage to the gauges. A perforating gun can be positioned below the gauge carrier and affixed to the gauge carrier with the perforating gun being conveyed by tubing. The perforating gun is normally actuated by dropping a rod of sufficient length and weight to cause the explosive charge within the perforating gun to perforate the casing and allow the reservoir fluids to enter the casing and pass upwardly through the gauge carrier to the surface in order for measurement data to be obtained. Thus, the pressure recording gauges measure bottom hole pressure, temperatures and other conditions while the well is flowing or while the well is shut-in.

While this arrangement for gathering downhole pressure and other data has been used, it has some shortcomings. Inasmuch as the pressure recording gauges have to be run in the hole with the test string, the gauges must be programmed prior to being run into the hole. Also, the gauges undergo violent shocks when run in the hole in conjunction with tubing conveyed perforating guns thus requiring service companies and operators to run multiple gauges in order to assure accurate and proper data gathering with it being common practice to run four, six and sometimes eight gauges at one time to assure data recording. Further, in the known arrangement, the pressure recording gauges cannot be retrieved without killing the well and going through the tedious process of removing the test string from the well.

SUMMARY OF THE INVENTION

An object of the present invention is to provide a wireline retrievable tubing conveyed gauge carrier enabling bottom hole pressure and other conditions to be measured and recorded for evaluation of reservoir potential in determining the feasibility of an oil or gas well to be completed and put into production subsequent to the well being drilled with the gauge carrier enabling preliminary steps such as circulation and conditioning mud with a different completion fluid being achieved and a packer set when ready with the gauges being run in the hole after the reservoir is perforated thereby eliminating shock to the gauges and enabling a minimal number of gauges to be used thereby incurring less expense and the gauges can be retrieved from the gauge carrier at any time with a wireline thereby allowing the operator to review data and if necessary run the gauges back in the hole thereby overcoming the shortcomings of existing drillstem testing procedures.

Another object of the invention is to provide a gauge carrier in accordance with the preceding object in which the equipment and method overcome existing problems encountered when endeavoring to measure and record bottom hole pressures or other conditions during temporary flow tests as well as with a permanent hookup on a well completion with the bottom hole pressure gauges or tools being run in and out of an oil/gas well with the gauges being set in a manner that they can accurately record bottom hole pressure without affecting the flow stream and without being affected by introduced mud or produced foreign particles such as sand, shale and the like in the bore hole of a well.

A further object of the invention is to provide a gauge carrier that can be conveyed by tubing and would be on the tubing above or below a packer as a part of a temporary or permanent completion with the gauges being run into the hole with the completion string and provided with the protection of a wireline plug affixed to an X-lock or similar type nipple in the carrier to keep foreign particles from covering the gauges while running into the hole or while going through the completion process with the wireline plug being removed once the completion process is complete and the well flow tested with the wireline retrievable bottom hole pressure gauges then being retrieved.

Still another object of the invention is to provide a gauge carrier in accordance with the preceding objects constructed to enable the bottom hole pressure gauges to be retracted, checked for sufficient information and then be laid aside if information is sufficient or, if the information is not sufficient, the gauges can be run back into the bore hole and hung off again with this procedure being capable of accomplishment at any time during flowing and/or shut-in conditions of the well.

A still further object of the invention is to provide a gauge carrier in accordance with the preceding objects which can be run in the bore hole under various conditions such as with an X-type plug in an upper X-lock nipple and completion procedures completed with the plug then being retrieved with the wireline and one or more bottom hole pressure gauges run into the gauge carrier and affixed in the same X-lock nipple or onto a no-go nipple that is part of the gauge carrier with the X-plug then being set in the upper part of the gauge carrier or left out as predetermined from bore hole conditions and produced well effluents.

Yet another significant feature of the present invention is to provide a gauge carrier and associated downhole equipment that provides a new and simpler method of taking and recording downhole measurements in which the components are either existing components that are readily available or components which can be easily constructed and maintained with the carrier constructed to accept standard gauges which can be installed and removed by wireline methods with the body of the gauge carrier being perforated to provide free-flow areas adjacent to the gauges with the system and method being simple to install and operate thus requiring limited training of operators.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic illustration of a well with the gauge carrier of the present invention incorporated therein.

FIGS. *2a*, *2b*, *2c* and *2d* are sequential, longitudinal, sectional views, on an enlarged scale and from top to bottom, of the gauge carrier of this invention.

Figure 3:
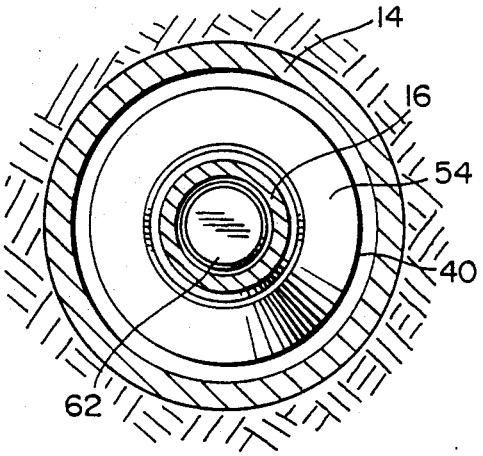

FIG. 3 is s a transverse, sectional view taken substantially upon a plane passing along section line 3—3 on FIG. *2a* illustrating further structural details of the invention.

Figure 4:
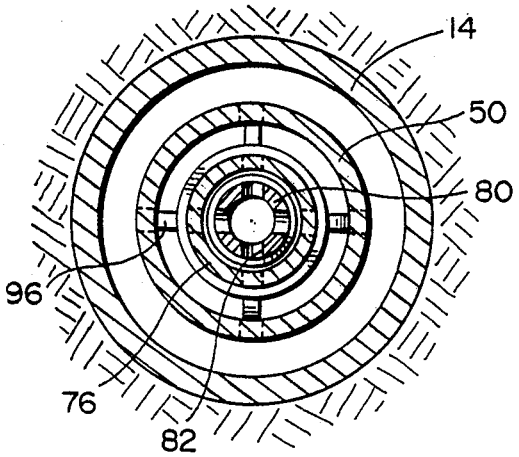

FIG. 4 is a transverse, sectional view taken substantially upon a plane passing along section line 4—4 on FIG. *2b* illustrating further structural details of the invention.

Figure 5:
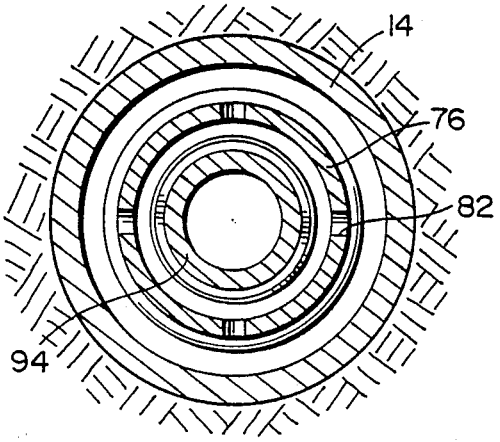

FIG. 5 is a transverse, sectional view taken substantially upon a plane passing along section line 5—5 on FIG. *2d* illustrating further structural details of the invention.

FIG. 6. is a schematic view similar to FIG. 1 but illustrating a modified structure in association with the gauge carrier of this invention.

Figure 8:
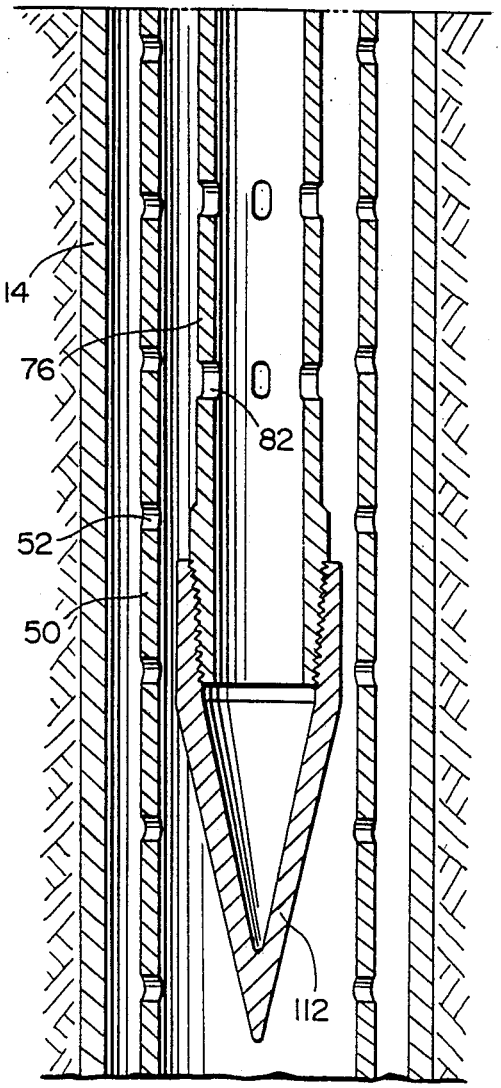

FIG. 7 is a schematic view illustrating another embodiment of the invention, FIG. 8 is a fragmental, sectional view similar to FIG. *2d* illustrating a tapered plug in lieu of the no go seat.

Figure 9:
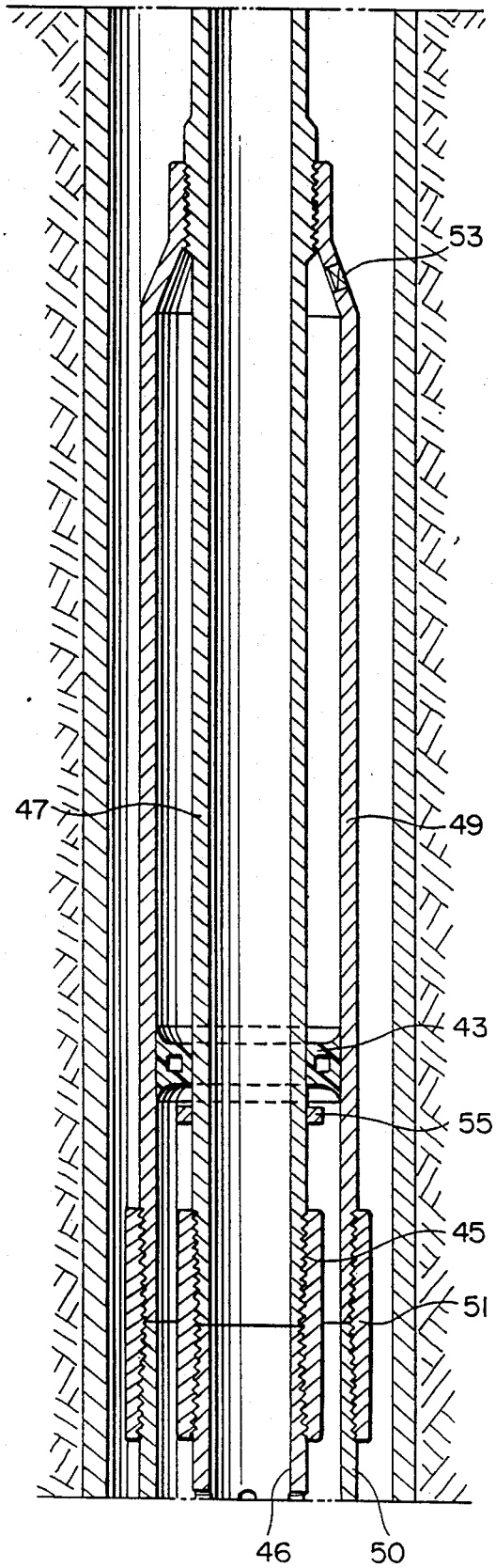

FIG. 9 is a sectional view similar to FIG. *2a* illustrating a shock absorber structure at the upper end of the inner and outer tubes.

DESCRIPTION OF THE PREFERRED EMBODIMENTS

Referring now specifically to FIG. 1, the wireline retrievable tubing conveyed gauge assembly of the present invention is generally designated by reference numeral 10 and illustrated in an oil or gas well generally designated by the reference numeral 12 which includes a casing 14 with production tubing 16 positioned therein with a wellhead 18 at the upper end of the casing and tubing. A wireline unit 20 having a wireline 22 extending therefrom and over a pulley 24 extends downwardly into the production tubing 16 which is provided with a packer 26 adjacent the lower end thereof with the gauge carrier 10 of this invention being positioned below the packer 26. A downhole casing perforator 28 is provided below the gauge carrier 10 for perforating the casing and formation 30 in a manner that is well-known.

FIGS. 6 and 7 illustrate alternate arrangements with FIG. 6 illustrating the gauge carrier 10 associated with the production tubing 16 in the same manner but, in this arrangement, the gauge carrier has a tubing pup joint 32 extending downwardly therefrom with the downhole casing perforator 28 being connected to the pup joint and a packer 34 is mounted on the pup joint in sealing contact with the casing 14 below the gauge carrier 10. In FIG. 7, the gauge 84 includes stabilizers 36 with the upper end of the gauge 84 including a fishing neck 38 and the wireline 22 extending upwardly therefrom. In each form of the invention, the upper end of the gauge carrier includes a tubing adaptor to connect the gauge carrier to the production tubing 16. FIGS. 1, 6 and 7 illustrate schematically the method of using the gauge carrier of the present invention with the specific structural details of the gauge carrier being illustrated in the other drawing figures.

FIG. *2a* illustrates the casing 14 and the production tubing string 16 and the packer 26 located above the tool 10 of this invention. The tool 10 is connected to the production tubing 16 by an adaptor collar 40 that connects the tubing 16 to the tool 10 with the collar including a double box connection at 42 and 44 with the box connection 42 connected to the production tubing 16 and the box connection 44 connected to an inner barrel 46 forming part of the tool. The adaptor collar 40 also includes a box connection 48 larger than the box connection 44 and extending axially generally in concentric spaced relation to the inner barrel 46 with the box connection 48 being connected to an outer barrel 50. The inner barrel 46 and the outer barrel 50 are provided with circulating slots 47 and 52, respectively, which are misaligned in relation to each other. The inner and outer barrels 46 and 50 are concentrically spaced in relation to each other and are spaced from the interior of the casing 14. The circulating holes 52 may be circular or elongated slot-type holes. The upper end of the collar 40 is beveled or inclined at 54 and the juncture between the box connection 48 and the box connection 44 is also beveled or inclined at 56 with the angle of inclination of the surfaces 54 and 56 being 45° or a similar angle.

Figure 2A:
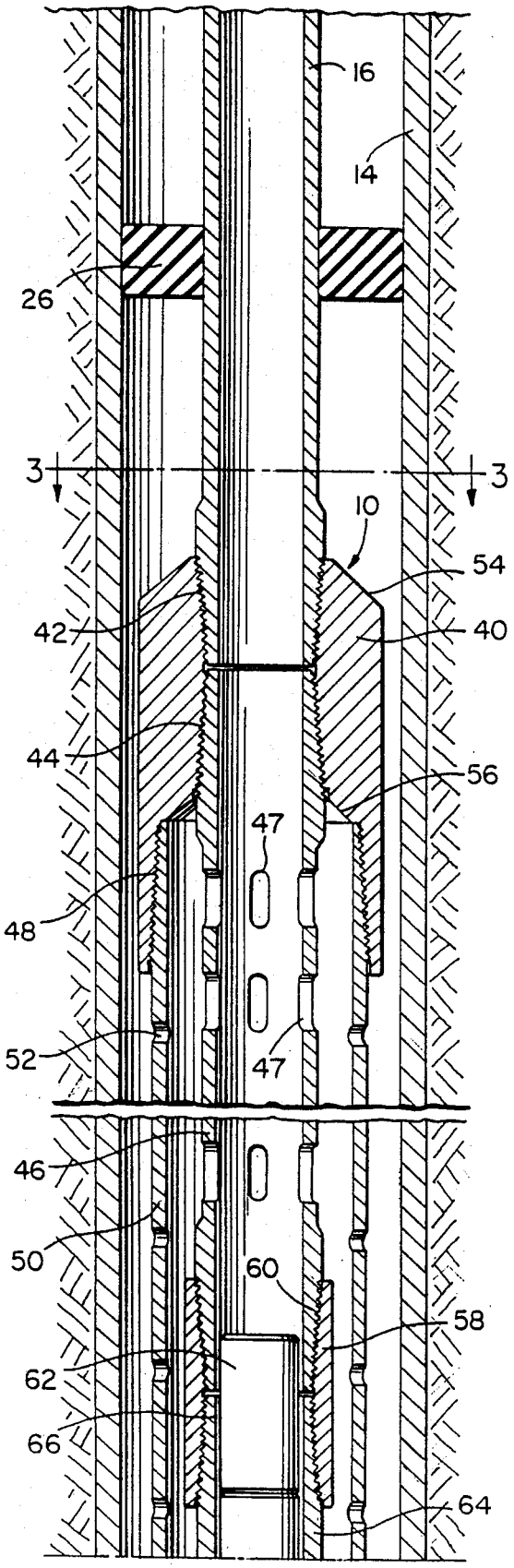
Figure 2B:
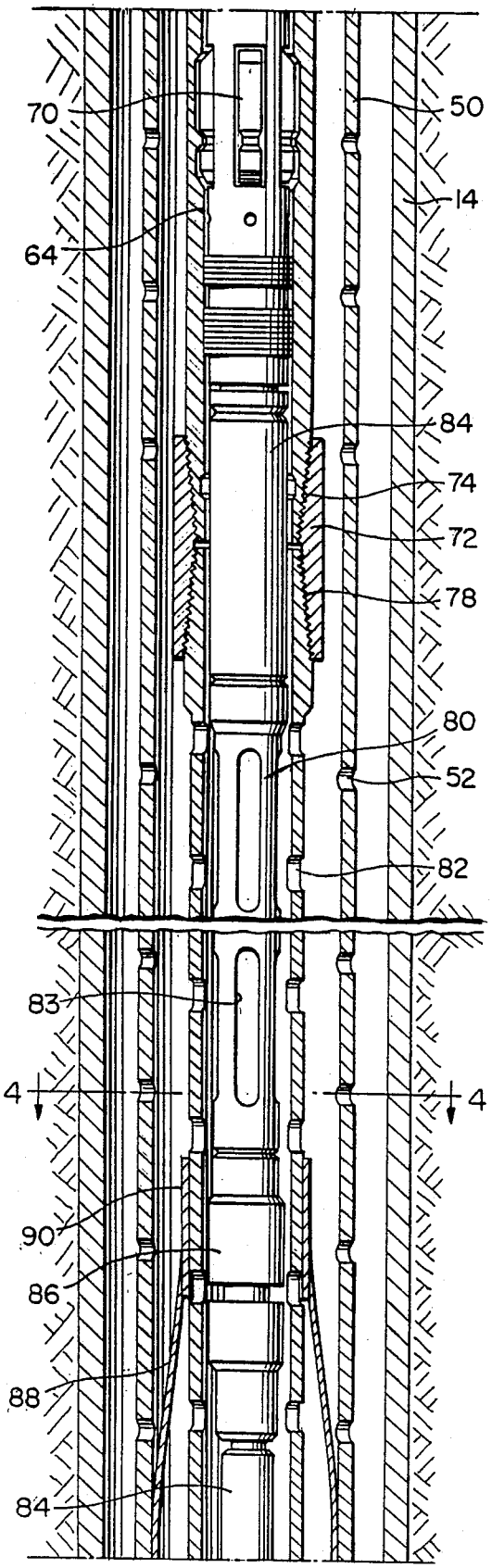
Figure 2C:
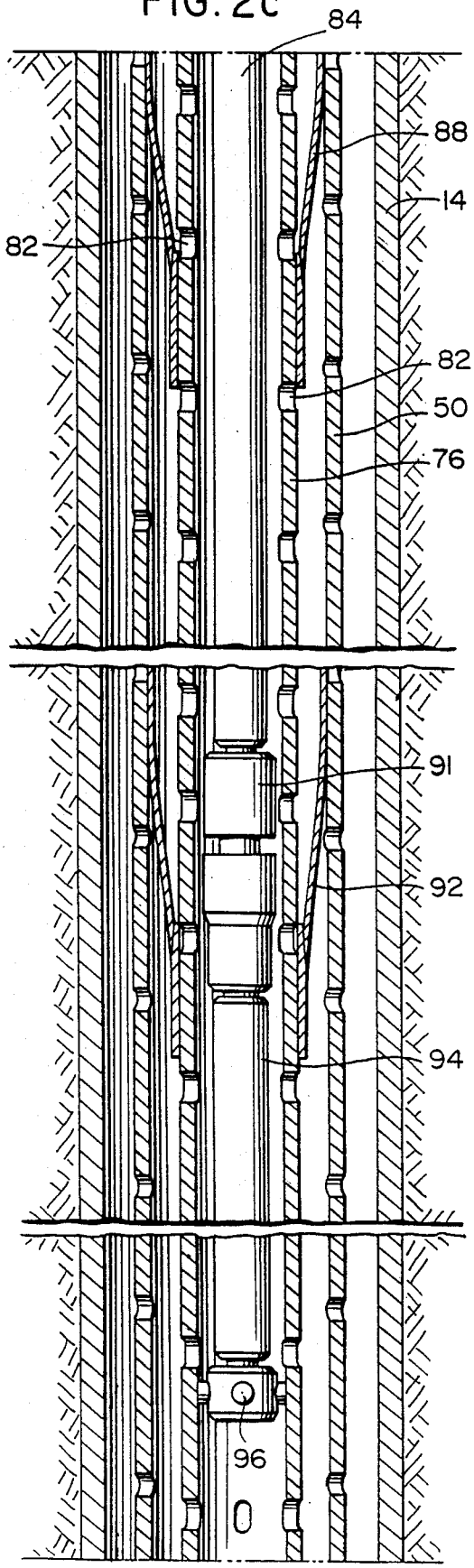

The inner barrel 46 is connected to a collar 58 at the lower end thereof through a box connection 60 and the outer barrel 50 extends past the collar 58 to the lower end of the tool as described hereinafter with the outer barrel 50 including circulating holes 52 throughout its length. The collar 58 supports a fishing neck 62 at the upper end of a locking mandrel 64 which is received in a landing nipple 66 with the landing nipple being a commercially available type X landing nipple. The locking mandrel 64 includes a central passageway to enable flow through the mandrel which is locked by a locking structure 70. The lower end of the landing nipple is connected to a collar 72 by a box connection 74 with the other end of the collar 72 being connected to a pup joint 76 through a box connection 78 with a concentric pup joint 80 connected with the locking mandrel with both pup joints 76 and 80 including circulating holes 82,83 with the pup joints spaced from each other. The inner pup joint 80 is connected to a gauge 84 through a knuckle joint 86. The pup joint 80 is maintained in spaced and concentric relation to the outer barrel 50 by a spring centralizer 88 in the form of outwardly bowed leaf springs connected with an annular member 90 encircling the pup joint 76 at the knuckle joint assembly 86 and at a lower point on the pup joint 76 as illustrated in FIG. 2c. A second spring centralizer 92 encircles a lower portion of the pup joint 76 to maintain the concentric spaced relation between the pup joint 76 and the outer barrel 50 with a knuckle joint assembly 91 connecting the gauge assembly 84 with a downhole gauge assembly 94 that includes radially extending centralizers 96 at the lower end thereof which maintains the spaced relation between the gauge assembly 94 and the pup joint 76.

Mounted on the lower end of the slotted inner tube 76 is a retainer collar 98 for a no-go seat 100 with the no-go seat being connected to the gauge carrier by a box connection (unnumbered). Connected to the lower end of the outer barrel 50 is an adaptor 102 to connect the tool to a perforating gun 28 or the like with the adaptor 102 including a box connection 104 to the outer barrel 50 and a reducing area 106 having an axial extension 108 connected to a tubing conveyed perforating gun or device 28 by a pin and box connection 110.

This structure enables a different procedure to be used in which the drillstem test string can be run into the hole and the packer 26 set without the delicate recording gauges being installed thereby eliminating possible damage to those gauges. This structure and procedure also enables the reservoir and formation surrounding the casing 14 to be perforated without damaging the bottom hole pressure gauges and the flow can be diverted into the annulus between the outer barrel 50 and the slotted inner barrel 76 resulting in no flow restriction and the installed wireline bottom hole pressure gauges will be in pressure contact but not in flow contact. By using the X-type wireline nipple and mandrel affixed therein and the bottom hole pressure instruments below the mandrel orients the fishing neck 62 positioned in the flow stream which keeps the fishing neck clean of produced sand, shale, mud and any other extraneous material. Due to the configuration of the device and the perforated flow tube above the X-type nipple, any extraneous material in the production tubing 16 that may fall back down the production tubing while the well is flowing or shut-in will fall through the perforated nipple and down through the barrel and tubing annulus and through the bottom part of the assembly without affecting removal of the wireline mandrel with the affixed bottom hole pressure gauges. This structure also enables the gauge carrier to be run in above or below a packer 26 and when the gauge carrier is oriented below the packer, the perforated outer barrel 50 allows the well to produce even though the tubing conveyed perforator 28 does not fall off. The use of an X-type nipple allows a through tubing perforating gun to go through the gauge carrier when this perforating method is preferred. Also, the present invention allows the user to run the bottom hole gauges as needed independent of any other operation, allows the user to retrieve the bottom hole pressure gauges as needed independent of any other operation with this procedure being capable of repetition as many times as required until necessary flowing and shut-in bottom hole pressures are obtained.

Other advantages of this invention include the self-cleaning and flushing of any debris and drilling mud through the inner barrel ports or holes and the full open bottom end thus eliminating accumulation of debris and drilling mud during other operations. Using the typical nipples and flow through mandrel and attaching an elongated flow through ported nipple below the fishing neck will allow self-cleaning of the recessed fishing neck thus allowing any debris to fall through instead of accumulating and possibly making retrieval of the mandrel and attached bottom hole pressure gauges difficult or impossible. A shock absorber is attached to the elongated ported nipple and a knuckle joint is provided to give flexibility with the bottom hole pressure gauges and stabilizers holding the gauges centered and out of destructive contact with the inner barrel.

In the event a well is already perforated, the below packer installation method allows setting the bottom hole pressure gauges directly across the reservoir for maximum precision and accuracy with the delicate bottom hole pressure gauges being doubly protected by the inner and outer barrels. When the gauge carrier is run in the hole on a tubing string above the packer, the outer barrel will not be ported or provided with holes which will allow all normal operations such as circulating drilling mud or completion fluid, setting the packer and perforating with through tubing or tubing conveyed perforator. When using a through tubing perforator, this would require that the bottom hole pressure gauges be run down the tubing string after perforation is completed which is similar to the perforating operation when the drop rod is used to detonate the perforating gun. Another method of detonating the perforating gun is to apply hydraulic pressure from the surface with a pump down the tubing string with such pressure, when applied, resulting in the gun detonating with the gauge carrier of this invention allowing the user to detonate the perforating gun or device without the bottom hole pressure gauges in place which is not capable in presently available structures and methods which have the bottom hole pressure gauges mounted securely and in rigid fashion in slots in a carrier without any flexibility so that the tremendous shocks created when the perforating gun is fired are directly conveyed to the delicate gauges which often renders them damaged and unable to perform their function which is the primary reason that a user employing present day equipment runs four, six and sometimes up to eight gauges in the presently available carrier.

The method incorporated with this invention allows the user to have the bottom hole pressure gauges in the carrier when the perforating gun is detonated by hydraulic pressure thereby providing minimal possibility that damage can occur because the gauges are not rigidly affixed on both ends inasmuch as the gauges affixed to the lower end of the mandrel are hanging and cushioned from damage by the shock absorber, the knuckle joints and the stabilizers affixed to the gauges.

Presently available mandrels are not drilled through between the slotted ports and lower threaded portion and therefore must be adapted by drilling through its juncture with the slotted ported nipple to the lower end thereof whereby the threaded portion on the very lower end which supports the gauges can be accessible to the gauges which can be screwed onto and hung below the mandrel. Slotted ports are provided between the lower threaded end and the seal area with flow being through the threaded lower portion with the drilling through of the mandrel allowing debris to fall through the nipple and thus into the larger inner slotted barrel rather than possibly getting trapped in the mandrel and building upwards into the mandrel and possibly filling it and making it difficult or impossible for pulling tools to remove the same as may be required at different intervals. The size, length, diameters and other dimensions of the components may be varied depending upon the installational requirements and primarily depending upon the number of bottom hole pressure gauges to be mounted.

The gauge carrier system is primarily adapted for use in a temporary testing mode whereby the customer or user will be provided preliminary information to determine whether the oil, gas or water well is productive and can be completed for long-term production. If the producing well has sufficient reserves that warrant its completion, the gauge carrier can be used as a part of the permanent completion package whereby the customer or user can periodically lower the bottom hole pressure gauges into the gauge carrier and obtain additional reservoir information as needed and not lose oil and gas production and not restrict the flow. Also, the gauge carrier of this invention is adapted to handle any gauges presently on the market whereas the existing gauge carriers are constructed specifically to support, handle and receive the gauges of specific manufacturers thereby rendering this device more flexible in use since gauges that may already be owned by or available to a customer or user can be used with the gauge carrier.

Figure 2D:
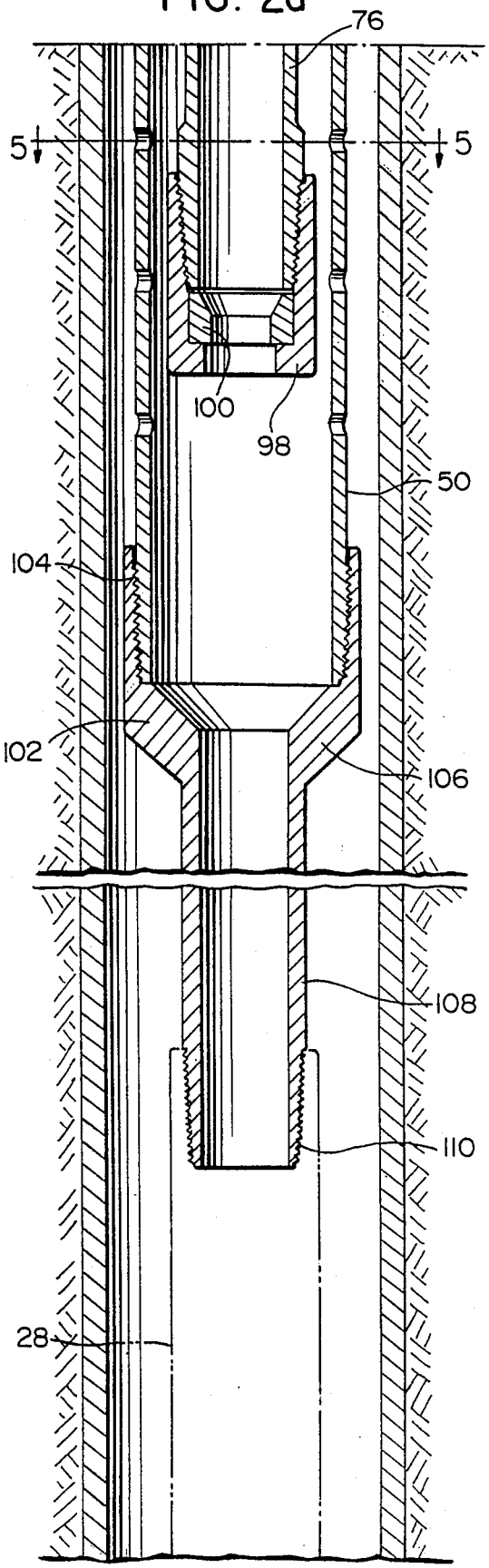

FIG. 8 illustrates another advantage of this invention which involves the capability of using a tapered bull plug 112 on the lower end of the slotted inner tube 76 or barrel in lieu of the no-go seat or nipple 100 shown in FIG. 2*d* for dissipating the instantaneous surge of energy and upper thrust created when the perforating gun is detonated in unbalanced conditions thereby avoiding compression and possible destruction of the inner tube and bottom hole pressure instruments encased therein.

Additionally, by lengthening the inner tube 46 above the slotted ported portion and below the upper adapter collar 40 and lengthening the outer tube 50 above the slotted portion, gas can be trapped in the upper annular space when lowered into the fluid in the well bore with fluid acting as a sealant that will create a shock absorber effect when the perforating gun is detonated at the bottom of the well bore. As illustrated in FIG. 9, a piston or pack-off 43 can be positioned in the annular space between extended inner tube 47 connected to tube 46 by a connector 45 and outer tube 49 by a connector 51 with nitrogen under pressure can be injected through a suitable connection 53 when it is above ground to increase the effective volume in the shock absorber. This piston would be movably mounted in a manner that a mechanical stop 55 on the inner tube 46 would keep the piston from going below that predetermined stop but would allow the piston to move upwards on the inner tube as the hydrostatic pressure below the piston increases over the predetermined pressure injected in the annulus base as the gauge carrier is lowered deeper and deeper into the well bore that contains the well fluid.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A carrier for gauges used in measuring and recording bottom hole pressure and other conditions in a well to evaluate whether a drilled well should be placed into production, said gauge carrier comprising concentrically spaced tubular outer and inner barrels connected to a production tubing positioned in a well casing generally in the area of the production formation and reservoir, an elongated tubular member disposed within the inner barrel in concentrically spaced relation for removably supporting measuring gauges in suspended relation interiorly of the inner barrel, said elongated tubular member enabling a through tubing perforating gun to pass therethrough and enabling wireline retrieval and tubing conveying of the gauges into and out of the well to enable gauges to be run in the well after perforation thereby reducing shock to obtain accurate measurement of bottom hole pressure and other conditions with a minimum number of gauges.

2. The structure as defined in claim 1 wherein said outer and inner barrels are connected to production tubing by an adapter collar having a double box connection with the production tubing and inner barrel and a concentrically spaced box connection with the outer barrel.

3. The structure as defined in claim 2 wherein said elongated member includes a fishing neck at the upper end thereof positioned within the inner barrel.

4. The structure as defined in claim 3 further comprising spring centralizers oriented between the inner and outer barrel at longitudinally spaced points to maintain the spaced concentricity thereof.

5. The structure as defined in claim 4 wherein said elongated member includes an upper portion and a lower portion interconnected by a knuckle joint assembly with the lower end of the elongated member including a no-go nipple having centralizers on the outer periphery thereof.

6. The structure as defined in claim 5 wherein said elongated member includes a locking mandrel at the upper end thereof connected to the inner barrel and including a through passageway to enable debris, sand and other material to pass downwardly and be discharged through a slotted ported nipple between the concentrically arranged barrels and elongated member.

7. The structure as defined in claim 6 further comprising a collar connected to the lower end of the outer barrel and having a reduced connection to a perforating gun positioned below the gauge carrier.

8. The structure as defined in claim 7 further comprising packer located selectively above or below the elongated member.

9. The structure as defined in claim 7 wherein said inner barrel includes an upper inner barrel and a lower inner barrel, said lower inner barrel being slotted vertically to restrict flow into the inner barrel thereby retaining flow in the annular space and permitting minimum flow and debris in relation to the gauges thereby making the gauges pressure responsive and not flow responsive.

10. The structure as defined in claim 9 wherein said upper inner barrel is slotted vertically whereby flow from the formation will not be restricted due to the total area available for flow being at least equal to the net area of the annular space.

11. The structure as defined in claim 7 further comprising a no-go nipple mounted on the lower end of the inner barrel to dissipate and restrict the instantaneous surge and upward thrust created when the perforating gun is detonated.

12. The structure as defined in claim 7 further comprising a downwardly tapered plug mounted on the lower end of the inner barrel to dissipate the instantaneous surge and upward thrust created when the perforating gun is detonated.

13. The structure as defined in claim 7 wherein said inner and outer barrels are provided with upwardly extending nonperforated extensions at their upper ends to define an annular space, means closing the upper end of the annular space to trap gas therein as the barrels are lowered into fluid in the wellbore to form a shock absorber effect when a perforating gun is detonated.

14. The structure as defined in claim 13 further comprising a piston slidable in said annular space in sealing engagement with the inner and outer barrels, means limiting downward movement of the piston, and means admitting pressurized gas in the annular space above the piston to increase the shock absorber effect as hydrostatic pressure below the piston increases to a pressure above the pressure of the gas admitted into the upper end of the annular space.

15. The structure as defined in claim 1 wherein the lower end of the inner barrel includes a tapered plug to dissipate the instantaneous surge of energy and upward thrust resulting from detonation of a perforating gun below the plug.

16. The structure as defined in claim 1 wherein said inner and outer barrels are provided with upwardly extending nonperforated extensions at their upper ends to define an annular space, means closing the upper end of the annular space to trap gas therein as the barrels are lowered into fluid in the wellbore to form a shock absorber effect when a perforating gun is detonated.

17. The structure as defined in claim 16 further comprising piston slidable in said annular space in sealing engagement with the inner and outer barrels, means limiting downward movement of the piston, and means admitting pressurized gas in the annular space above the piston to increase the shock absorber effect as hydrostatic pressure below the piston increases to a pressure above the pressure of the gas admitted into the upper end of the annular space.

* * * * *